US009863707B2

(12) United States Patent
Southall et al.

(10) Patent No.: US 9,863,707 B2
(45) **Date of Patent: *Jan. 9, 2018**

(54) FURNACE WITH REFRACTORY BRICKS THAT DEFINE COOLING CHANNELS FOR GASEOUS MEDIA

(71) Applicant: Hatch Ltd., Mississauga (CA)

(72) Inventors: Sean Southall, Acton (CA); Bert Wasmund, Milton (CA); Maciej Jastrzebski, Oakville (CA); Frank Stober, Mississauga (CA); Michael Parravani, Mississauga (CA); Robert Veenstra, Thamesford (CA); John Andrew Ferguson Shaw, Toronto (CA)

(73) Assignee: Hatch Ltd., Mississauga, Ontario (CA)

( * ) Notice: Subject to any disclaimer, the term of this patent is extended or adjusted under 35 U.S.C. 154(b) by 35 days.

This patent is subject to a terminal disclaimer.

(21) Appl. No.: 15/132,310

(22) Filed: Apr. 19, 2016

(65) Prior Publication Data

US 2016/0265849 A1 Sep. 15, 2016

Related U.S. Application Data

(62) Division of application No. 14/348,825, filed as application No. PCT/CA2012/000917 on Oct. 1, 2012, now Pat. No. 9,347,708.

(Continued)

(51) Int. Cl.

| | |
|---|---|
| ***F27D 1/12*** | (2006.01) |
| ***F27B 3/14*** | (2006.01) |
| ***F27B 3/10*** | (2006.01) |

(52) U.S. Cl.

CPC ..... *F27D 1/12* (2013.01); *F27B 3/10* (2013.01); *F27B 3/14* (2013.01)

(58) Field of Classification Search

CPC ..... F27D 1/12

See application file for complete search history.

(56) References Cited

U.S. PATENT DOCUMENTS

| | | | |
|---|---|---|---|
| 1,410,086 | A | 3/1922 | Weidenthal |
| 1,922,599 | A | 8/1933 | Murray et al. |

(Continued)

FOREIGN PATENT DOCUMENTS

| | | |
|---|---|---|
| CA | 1006695 | 3/1977 |
| CA | 2318171 | 7/1999 |

(Continued)

OTHER PUBLICATIONS

English Translation of Japanese Patent Application No. 2004053166.

(Continued)

*Primary Examiner* — Scott R Kastler

(74) *Attorney, Agent, or Firm* — Bereskin & Parr LLP

(57) ABSTRACT

A furnace is provided suitable for metallurgical processes, comprising at least one section comprised of refractory bricks with an outer shell plate adjacent to the refractory bricks, including exterior bricks whose external faces adjacent the shell plate define gaseous media cooling channels extending along the exterior of the refractory bricks between them and the shell plate. The furnace further comprises cooling plates within the cooling channels and joints between the successive courses of bricks. Advantageously, the conductivity of the cooling plates is at least 5 times the conductivity of the refractory lining into which it is inserted. Suitable materials include copper and copper-based alloys, brasses, bronzes, cast irons, aluminum alloys, silver, high-temperature steels, refractory metals and their alloys, graphite, silicon carbide, and aluminum nitride.

27 Claims, 9 Drawing Sheets

Related U.S. Application Data

(60) Provisional application No. 61/540,896, filed on Sep. 29, 2011.

(56) References Cited

U.S. PATENT DOCUMENTS

| | | | | |
|---|---|---|---|---|
| 2,230,142 | A | 1/1941 | Longacre | |
| 3,315,950 | A | 4/1967 | Potocnik | |
| 3,953,007 | A | 4/1976 | van Laar | |
| 4,119,792 | A | 10/1978 | Elsner et al. | |
| 4,332,554 | A | 6/1982 | van Laar | |
| 4,543,893 | A | 10/1985 | Kunnecke | |
| 4,619,441 | A | 10/1986 | Felthuis et al. | |
| 5,011,402 | A | 4/1991 | Hammond | |
| 5,785,517 | A | 7/1998 | Gray et al. | |
| 9,347,708 | B2 * | 5/2016 | Southall | F27D 1/12 |

FOREIGN PATENT DOCUMENTS

| | | |
|---|---|---|
| DE | 719137 | 3/1942 |
| GB | 494708 | 10/1938 |
| GB | 2270146 | 3/1994 |
| JP | 5478306 | 6/1979 |
| JP | 602609 | 1/1985 |
| JP | 2004053166 | 2/2004 |
| WO | 2006040394 | 4/2006 |

OTHER PUBLICATIONS

International Search Report of International Patent Application No. PCT/CA2012/000917.
International Search Report of International Patent Application No. PCT/CA2013/000311.
EnglishTranslation of Abstract of Japanese Patent No. 602609.
English Translation of Abstract of Japanese Patent No. 5478306.
English Translation of German Patent No. 719137.

* cited by examiner

FURNACE WITH REFRACTORY BRICKS THAT DEFINE COOLING CHANNELS FOR GASEOUS MEDIA

REFERENCE TO PRIOR APPLICATIONS

This application is a divisional of U.S. application Ser. No. 14/348,825, filed on Mar. 31, 2014 (now U.S. Pat. No. 9,347,708), which is a 371 of international application PCT/CA2012/000917, filed on Oct. 1, 2012 (which designated the U.S.), which claims the benefit of U.S. provisional application No. 61/540,896, all of which are incorporated herein by reference in their entirety.

TECHNICAL FIELD

The present invention relates to furnaces suitable for metallurgical processes, and particularly to furnaces having refractory brick side walls, or a refractory brick, hearth or roof, and gaseous media cooling systems.

BACKGROUND

The furnaces used in metallurgical processes typically have a crucible consisting of a refractory lining, composed of either bricks, blocks or monolithic refractories, with an adjacent outer shell or some other means of support for the refractory lining. Such furnaces hold a bath of molten metal or matte usually with an overlying slag layer.

Due to the aggressive nature of many slags produced in metallurgical processes, cooling is required to freeze a layer of slag on the inner surface of the vessel to maintain a stable side wall. As discussed in Voermann et al., *Furnace Cooling Design for Modern High Intensity Pyrometallurgical Processes* (Proceedings at the Copper 99—Cobra 99 International Conference, Phoenix, Ariz., U.S.A.), the cooling required is dictated by the process conditions in the vessel. To keep the crucible lining in equilibrium, the process heat flux imposed by the process must be matched by the cooling system's heat removal capacity.

In practice, a wide range of heat fluxes are encountered in various metallurgical furnaces. Heat fluxes are dependent on the intensity of the process and whether the containment is for slag or metal. Heat fluxes can typically range from a low value of about 5 kW/m2, which can be removed by natural air cooling, to over 2,500 kW/m2, which requires intense forced water cooling. Generally, for heat fluxes in the lower range, about 15 kW/m2 or less, forced air cooling of the furnace shell plate can be used. For heat fluxes above about 15 kW/m2, some type of water cooling is generally adopted to avoid overheating of the furnace shell plate and structural members.

Due to the potential risk of an explosion in the event that molten material from inside the furnace contacts water in the cooling system, it is desirable to avoid using water as the cooling medium wherever possible. For this reason it may be desirable to use a furnace cooling system which does not use water as a cooling fluid. Although typical air cooling systems cannot match the heat removal capacity of water cooling systems, they have a wider operating temperature range and hence offer significant advantages in cooling applications where adjustable heat removal rates are required.

A number of furnace cooling systems are known in which gaseous media is used as the cooling fluid. For example, U.S. Pat. No. 5,230,617 (Klein et al.) discloses a cooling arrangement in which a number of metal shrouds encircle a cylindrical furnace. Each shroud forms a hollow cooling chamber through which air is circulated, and into which water is atomized to enhance the cooling effect. However, the introduction of water vapour into the system will complicate the cooling air supply system, and create corrosion problems that will impact material selection. Both of these issues will increase complexity and cost.

U.S. Pat. No. 1,674,422 to Allen, Jr. et al. discloses an air-cooled furnace wall in which cast hangers support refractory walls separated by air circulation spaces. U.S. Pat. No. 3,315,950 to Potocnik et al. discloses a heating chamber wall for a furnace, in which the wall has an interior space through which air is allowed to circulate. U.S. Pat. No. 3,777,043 (O'Neill) discloses an annular air circulation channel formed within the refractory furnace wall. U.S. Pat. No. 4,199,652 (Longenecker) discloses J-shaped channels formed between the refractory side wall and the metal outer shell of a furnace U.S. Pat. No. 6,251,237 (Bos) discloses localized jets blowing directly onto the shell with variable flow for Hall-Heroult aluminum electrolytic pots.

In the above-mentioned patent to O'Neill, and in U.S. Pat. No. 1,751,008 (La. France), the structure of the refractory furnace side wall is modified to provide increased surface area for enhanced cooling. In La France, this is accomplished by forming vertical ribs and channels in the outer surfaces of the blocks making up the refractory walls. In O'Neill, the annular cooling channels can be made in the form of "tortuous paths" by using bricks of varying lengths. While these techniques can help to enable increased heat removal capacity, it is extremely difficult to distribute the air evenly over the wall, a problem which worsens as the furnace ages due to shifting and movement of the brickwork. Also, the addition of air into the brickwork behind the shell plate would not be feasible in many furnaces since air would react with the furnace products, e.g. CO gas, metals, etc. For some applications this method is of limited value as it does not provide sufficient cooling capacity.

Thus, known gaseous media-cooling arrangements for metallurgical furnaces generally provide insufficient cooling and/or are unduly complex, requiring specially constructed furnace side walls. Such systems are also relatively expensive and cannot be practically adapted to existing furnace installations.

SUMMARY OF THE DISCLOSURE

The following summary is intended to introduce the reader to the more detailed description that follows and not to define or limit the claimed subject matter.

In accordance with a first aspect of the present subject matter, a furnace is provided suitable for metallurgical processes, comprising at least one section comprised of refractory bricks with an outer shell plate adjacent to the refractory bricks, including exterior bricks whose external faces adjacent the shell plate define gaseous media cooling channels extending along the exterior of the refractory bricks between them and the shell plate. The furnace further comprises cooling plates within the cooling channels and joints between the successive courses of bricks. Advantageously, the conductivity of the cooling plates is at least 5 times the conductivity of the refractory lining into which it is inserted. Suitable materials include copper and copper-based alloys, brasses, bronzes, cast irons, aluminum alloys, silver, high-temperature steels, refractory metals and their alloys, graphite, silicon carbide, and aluminum nitride.

Advantageously, the gaseous media cooling channels are aligned with the joints between successive courses of brick of the refractory brick section. More advantageously, the channels are defined by complimentary recesses along adjacent upper and lower portions respectively of the successive courses of exterior bricks. In some examples, the refractory brick section is a side wall of the furnace.

In certain embodiments, the exterior bricks are tapered at their external faces such that successive courses of the exterior bricks together define gaseous media cooling channels between the side wall and the shell plate that have a generally triangular cross section. In some embodiments, the gaseous cooling media is air. In other embodiments the gas may be nitrogen, carbon dioxide, argon, or a combination, or other suitable gases.

In some embodiments, the furnace also includes inlets in the outer shell plate through which gaseous cooling media can enter the channels and outlets through which the gas is exhausted from the cooling channels. In some examples, the furnace includes a fan for blowing gas into the inlets and through the cooling channels.

According to another aspect of the present subject matter, there is provided a set of refractory bricks for use on the exterior of a refractory side wall of a metallurgical furnace having an outer shell plate adjacent to and supporting such a side wall, each of the bricks comprising an external face to be oriented adjacent the outer shell plate, the external faces of the bricks having profiles such that in use on the exterior of a refractory side wall, they define gaseous media cooling channels that extend generally along the exterior of such side wall, between such side wall and such shell plate.

BRIEF DESCRIPTION OF THE DRAWINGS

In order that the claimed subject matter may be more fully understood, reference will be made to the accompanying drawings, in which:

DETAILED DESCRIPTION OF EMBODIMENTS

Figure 1:
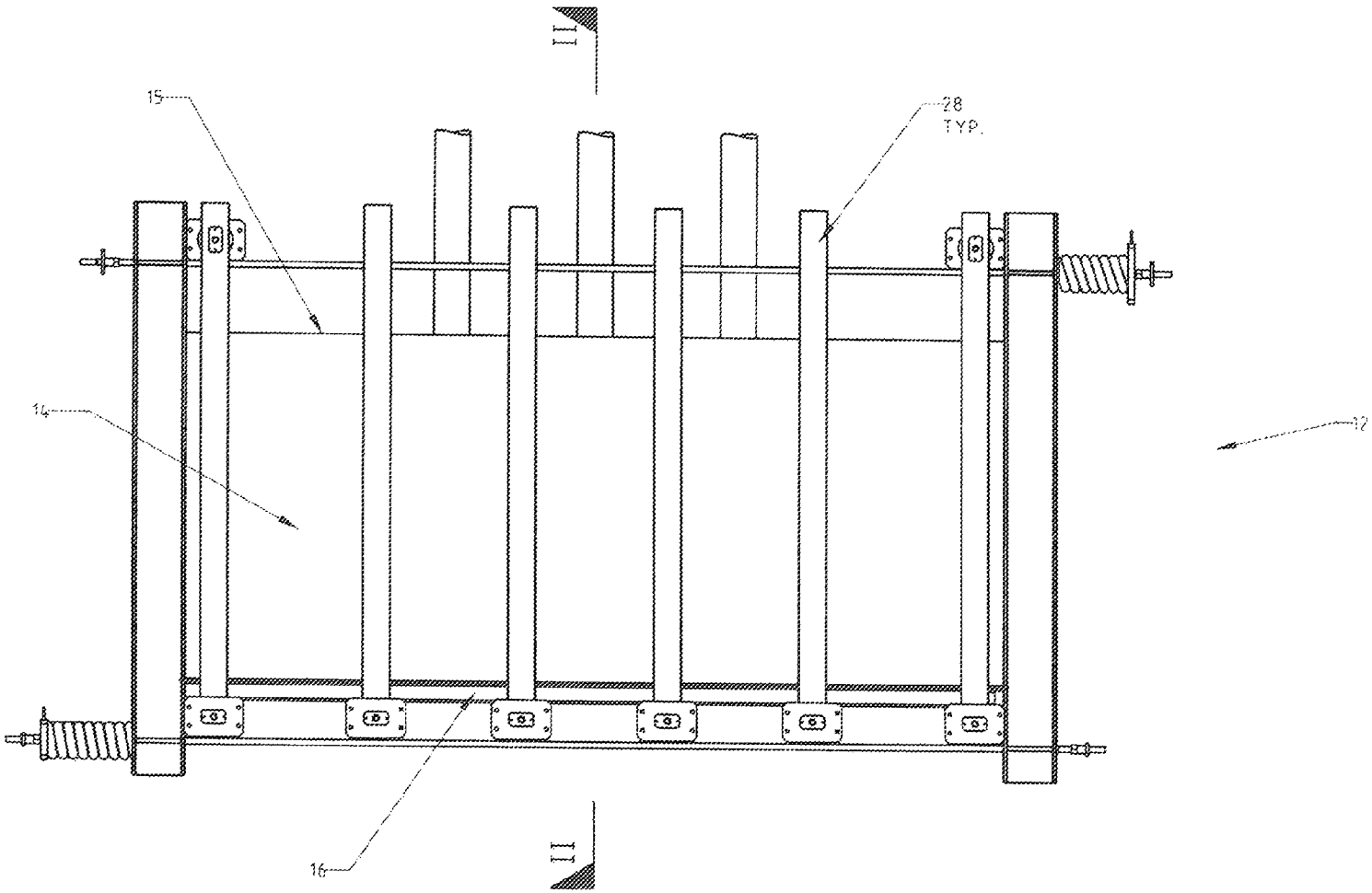
FIG. 1 is a side elevation view of a metallurgical furnace according to one embodiment of the invention.
Figure 2:
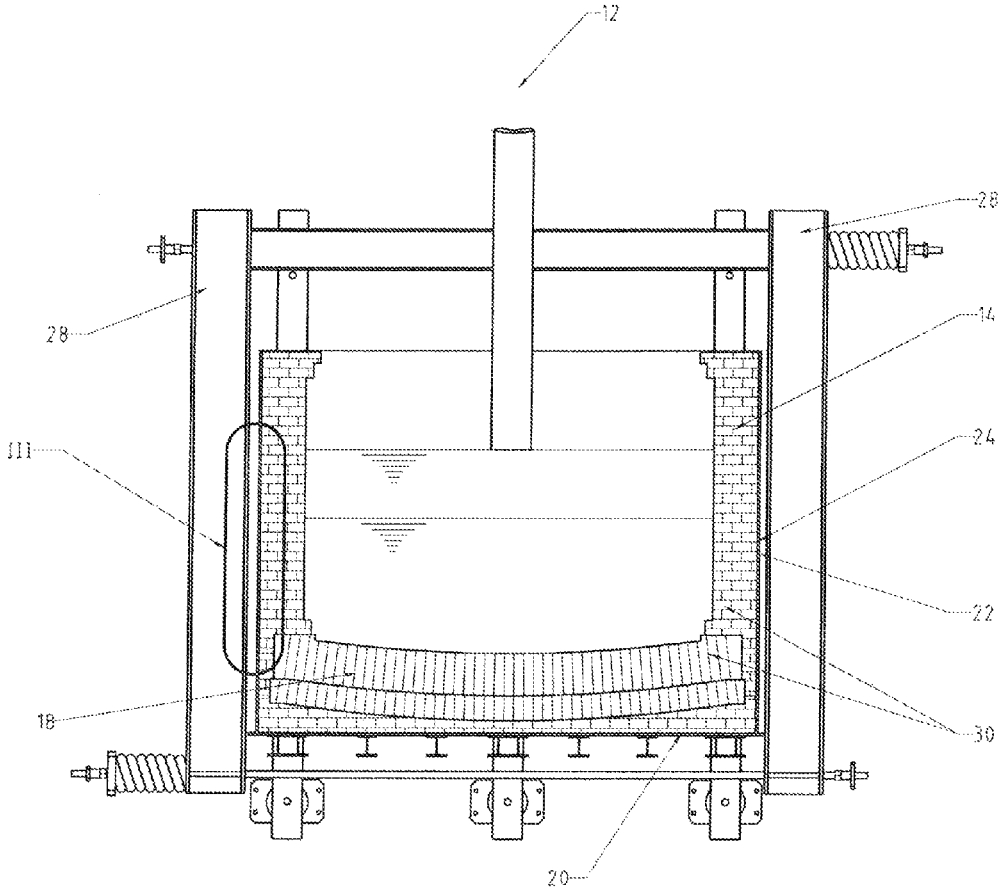
FIG. 2 is a cross sectional side view taken along line II-II of FIG. 1.

In the following description, specific details are set out to provide examples of the claimed subject matter. However, the embodiments described below are not intended to define or limit the claimed subject matter. It will apparent to those skilled in the art that many variations of the specific embodiments may be possible within the scope of the claimed subject matter.

As shown in the drawings, the furnace 12 has rectangular side walls 14 extending between an upper portion 15 and a lower portion 16 of the furnace 12, the lower portion 16 comprising a hearth 18 and a base 20. Both the hearth 18 and side wall 14 are formed of a refractory material, preferably refractory bricks 30. Surrounding the refractory side wall, hearth and base of the furnace is a structural metal shell 22, which has an inner surface 24 in contact with the side wall 14, hearth 18 and base 20, and an opposed outer surface 26 in contact with support columns 28.

Figure 3:
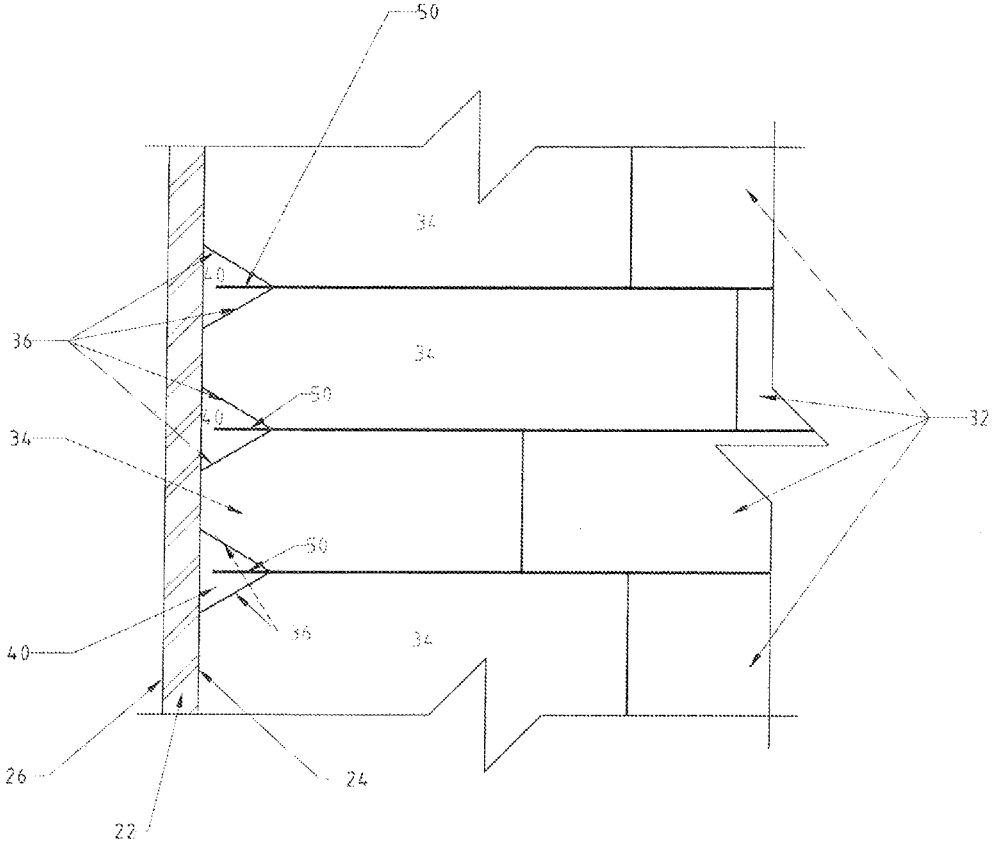
FIG. 3 is a detailed side view of the portion of FIG. 2 indicated by circle III.
Figure 4:
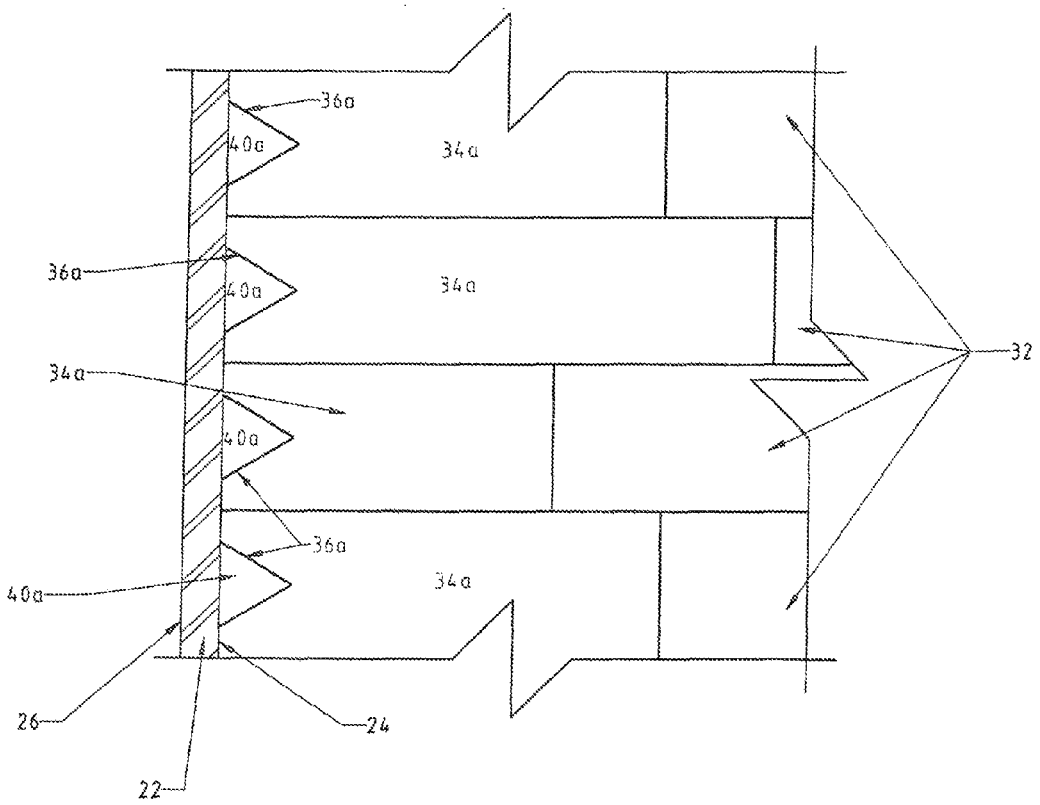
FIG. 4 is a detailed side view according to another embodiment.
Figure 5:
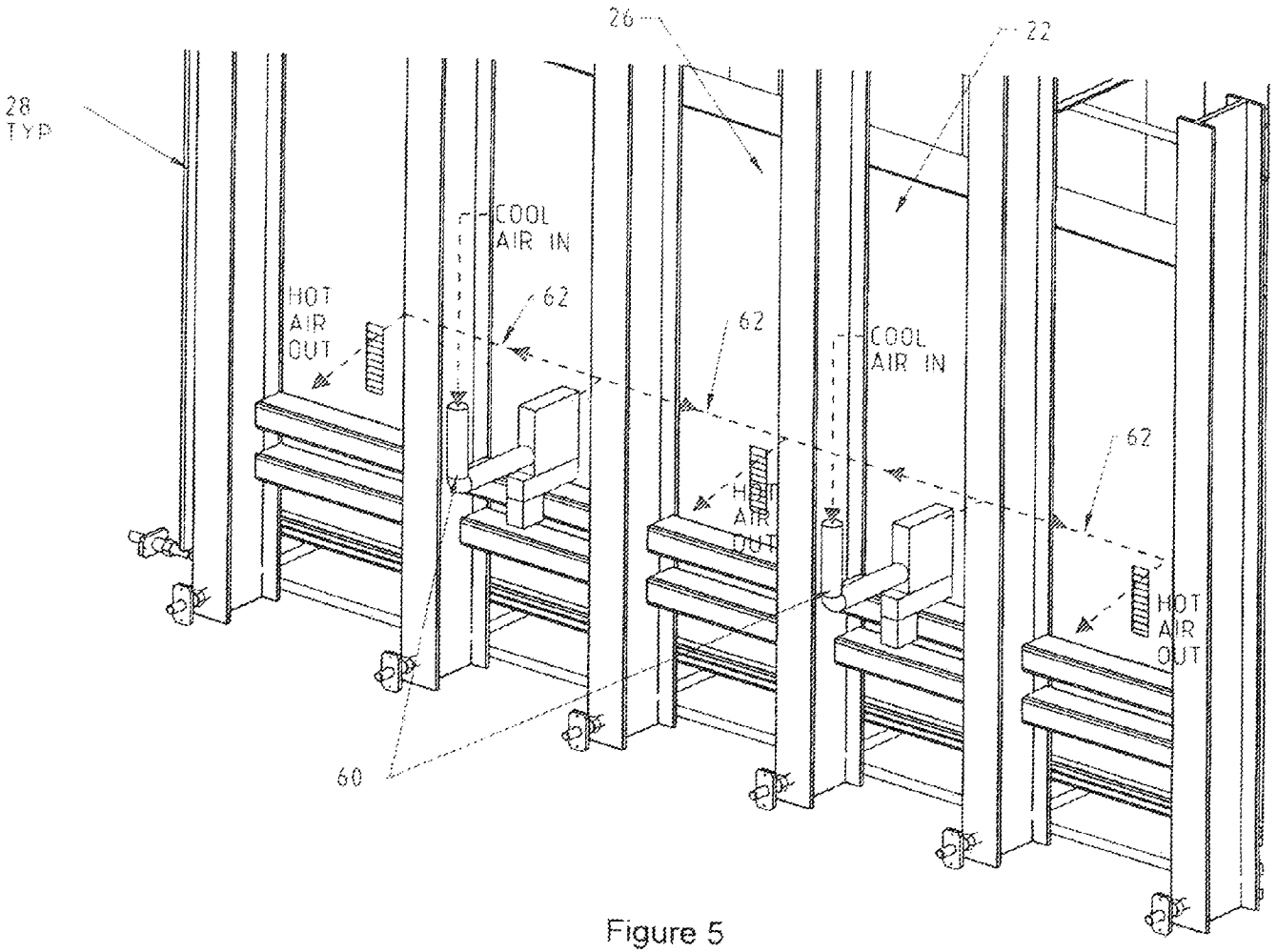
FIG. 5 is a detailed side isometric view of a portion of the exterior of the furnace of FIG. 1.

The refractory bricks 30 of side wall 14 are of two types: regular bricks 32 (which have a conventional rectangular prism or cuboid shape), and specially shaped channel bricks 34 which have tapered outer edges 36. In the embodiments of FIGS. 3 and 4, the contiguous tapered edges 36 of successive courses of channel bricks 34 define with the shell 22 generally wedge shaped horizontal cooling passages 40. Gaseous cooling media such as air is introduced by means of a blower (not shown) through inlets 60 which communicate with the cooling channels 40. The gaseous cooling media passes horizontally along the cooling channels 40 absorbing heat from the side wall 14 and is subsequently exhausted through outlets 62.

In the embodiment shown in FIG. 3, copper cooling plates 50 are sandwiched between successive courses of channel bricks 34, and extend outwardly into the cooling passages 40. The channel bricks 34 are slightly shorter than the regular bricks 32 to accommodate the cooling plates 50 while maintaining alignment of the channel bricks 34 and the regular bricks 32 in the same course. The cooling plates 50 increase cooling of the side wall 14 by conducting heat outwardly to the cooling passages 40 where the heat is transferred and removed by convection.

In the embodiment of FIG. 4, similar horizontal cooling passages 40*a* are defined by the shell 22 in combination with groove sides 36*a* in the external face of the channel bricks 34*a*.

There are a number of possible inlet and outlet configuration which can be applied to an gaseous media cooling system in a circular furnace. For example, one or more inlets may be provided at one end of the wall, and one or more outlets may be provided at the other end of the wall, such that the gaseous media circulation paths 62, 64 extend horizontally along the wall between the inlet(s) and the outlet(s). Alternatively, each end of the wall may be provided with one or more inlets, with the gaseous media flowing toward one or more outlets located centrally between the ends of the wall. It will be appreciated that other inlet/outlet configurations are possible.

When applied to a rectangular furnace, a separate cover member is preferably applied to each wall being cooled, with each wall preferably being provided with at least one inlet and at least one outlet. It will be appreciated that the cooling system can also be applied to circular or oval furnaces.

Figure 6B:
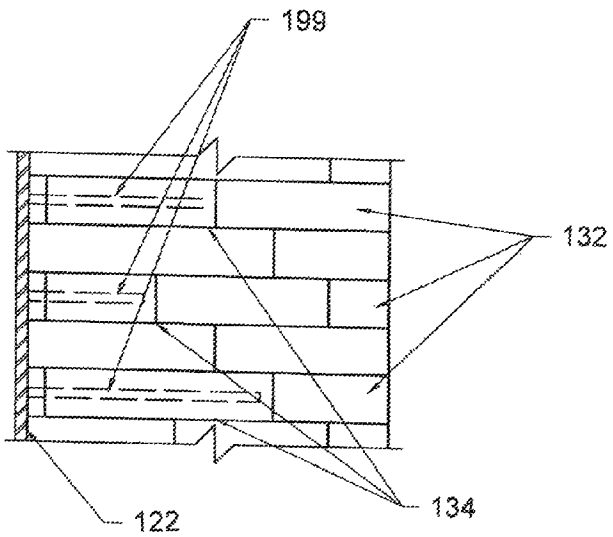
FIG. 6*b* is a cross sectional view of the embodiment of FIG. 6*a;*
Figure 6A:
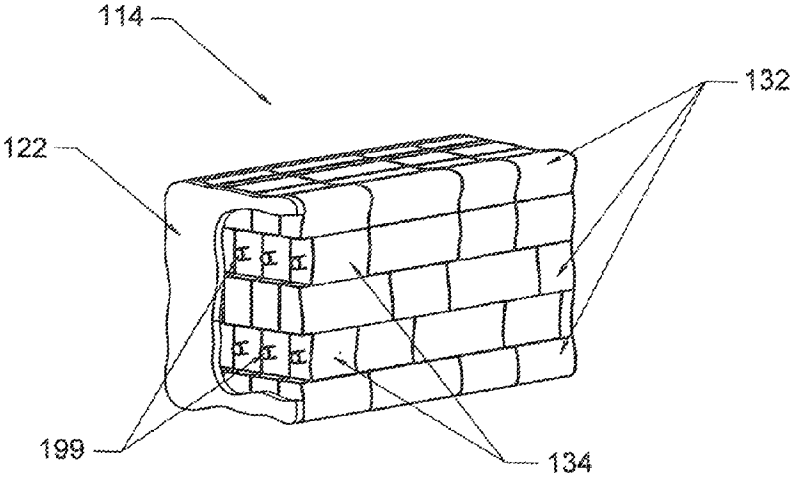
FIG. 6*a* is a schematic isometric view, partially cut away, of another embodiment.

Turning to FIGS. 6*a* and 6*b*, the wall 114 of a furnace comprises a plurality of bricks 132, 134 which are laid such that in alternative successive courses of bricks, a gap is provided between the edge of the brick 134 and the inner wall of the shell 122 defining a cooling channel 140. Gaseous cooling media passes horizontally along the cooling channels 140 absorbing heat from the side wall 114 and subsequently exhausting it through outlets. Cast in cooling rods 199 extend through the bricks 132 and into the cooling channels 140. The cast in rods 199 enhance the cooling.

Figure 7C:
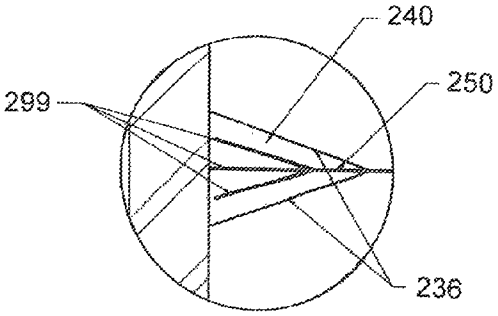
FIG. 7*c* is a detailed view of a portion of the embodiment of FIGS. 7*a* and 7*b;*
Figure 7A:
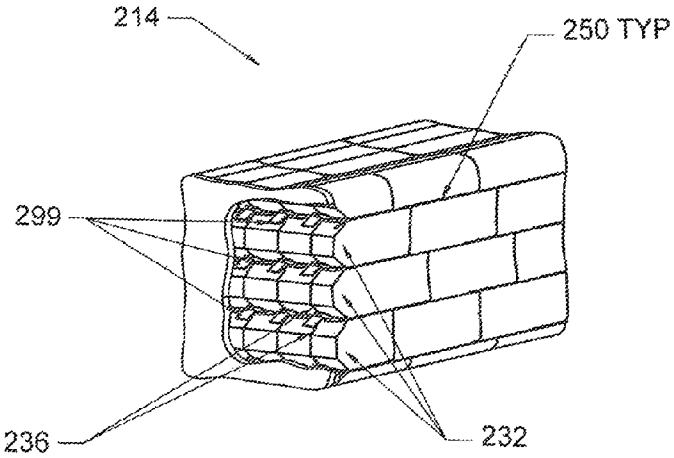
FIG. 7*a* is a schematic isometric view, partially cut away, of another embodiment.
Figure 7B:
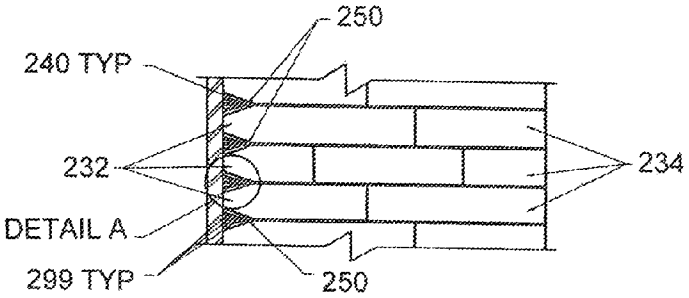
FIG. 7*b* is a cross section view of the embodiment of FIG. 7*a;*

Turning to FIGS. 7*a* and 7*b*, bricks 234 have tapered edges 236 defining wedge shape channels 40 similar to the embodiment shown in FIG. 3. Copper cooling plates 250 are sandwiched between successive courses of bricks 234. In this case, the cooling plates 250 terminate in fingers 299 that extend into the cooling channels 240 to enhance the cooling effect.

The present subject matter can be applied such that the cooling channels are shaped as circular, rectangular, or any shape which can be readily formed or cut into a refractory brick or cast refractory. The cooling channels may be oriented horizontally, vertically, or diagonally.

Figure 8:
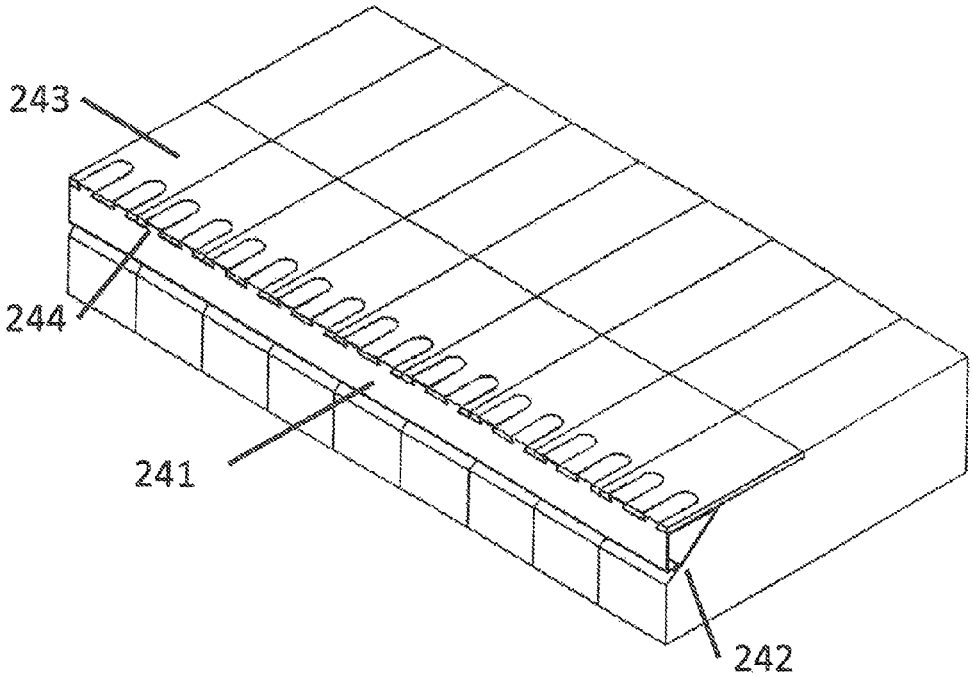
FIG. 8 is an isometric view of another embodiment.

Another embodiment is shown in FIG. 8, where a metallic cooling media conduit 241 is inserted into the cavity formed by the bricks 242. Conductive cooling plates 243 are inserted between the bricks and connected to the cooling media conduit 241. The plates are attached either by welding, bolts, dovetails 244, or clips to maintain thermal contact. Advantageously, the connection is designed such that thermal expansion increases the contact pressure.

Figure 9:
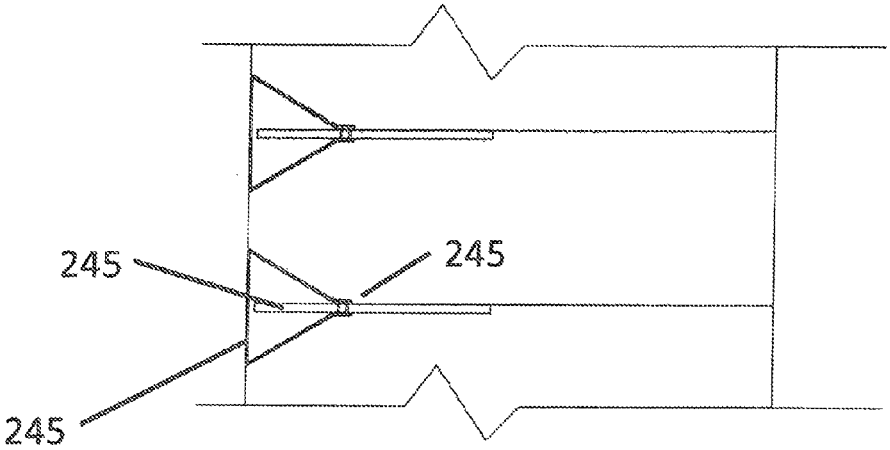
FIG. 9 is a side view of another embodiment.

Another embodiment is shown in FIG. 9, where a metallic cooling media conduit 245 is inserted into the cavity formed by the bricks. Conductive plates 246 are inserted between the bricks and clamped by the cooling conduit 245. Clamping force is exerted by welding, bolts, clips 247, or by forming the cooling media conduit 245 so as to produce a clamping spring. Advantageously, the connection is designed such that thermal expansion increases the contact pressure.

Figure 10:
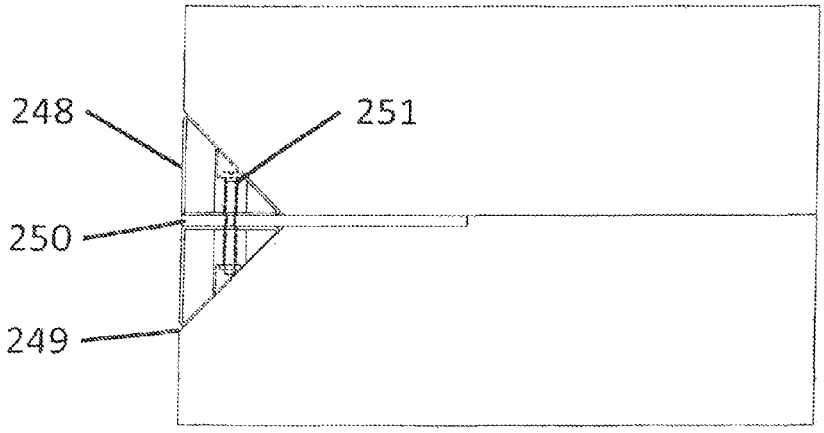
FIG. 10 is a side view of another embodiment.

Another embodiment is shown in FIG. 10, where a metallic cooling media conduit is 248 inserted into the cavity 249 formed by the bricks. Conductive cooling plates 250 are inserted between the bricks and penetrate the conduit 248 so as to be in direct contact with the cooling medium. Clamping force is exerted by bolts, clips 251, or by forming the channel so as to produce a clamping spring. Advantageously, the connection is designed such that thermal expansion increases the contact pressure.

Figure 11:
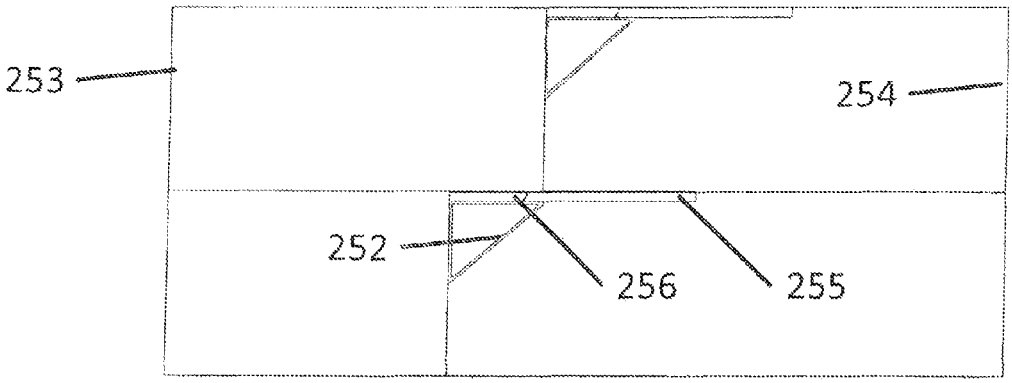
FIG. 11 is a side view of another embodiment.

Another embodiment is shown in FIG. 11, where the cooling media conduit 252 is inserted into a cavity positioned at an intermediate point between the cold face 253 and the hot face 254 of the lining. Conductive plates 255 are inserted between the bricks and connected to the conduit 252. The plates 255 are attached either by bolts, dovetails 256, or clips to maintain thermal contact. Advantageously, the connection is designed such that thermal expansion increases the contact pressure.

While the gaseous cooling media is typically air, in some embodiments, the cooling media may be nitrogen, carbon dioxide or an inert gas to prevent oxidation of the cooling channels, conductive plates or unwanted reactions in the process vessel.

It will be appreciated by those skilled in the art that many variations are possible within the scope of the claimed subject matter. The embodiments that have been described above are intended to be illustrative and not defining or limiting.

For example, while the embodiments above refer to furnace walls, the present subject matter could also be applied to hearths or roofs formed from refractory bricks mounted by an outer shell.

What is claimed is:

1. A furnace suitable for high temperature processes, comprising:

a crucible, defining at least a hearth and a wall, the crucible having an inner refractory lining, and an outer support structure adjacent to and supporting at least a portion of said refractory lining;

said refractory lining having at least a portion with an external face adjacent to said support structure, at least a part of said refractory lining having gaseous media cooling channels, and cooling plates within the cooling channels that provide thermal contact with the gaseous media, said cooling plates extending into said refractory lining.

2. The furnace of claim 1, wherein said gaseous media cooling channels extend along the exterior of said refractory lining, between said refractory lining and said support structure.

3. The furnace of claim 2, wherein at least a portion of the refractory lining includes exterior refractory bricks having profiled external faces that define said gaseous media cooling channels.

4. The furnace of claim 3, wherein said gaseous media cooling channels are aligned with joints between successive courses of said profiled exterior refractory bricks.

5. The furnace of claim 4, further comprising cooling plates located within said gaseous media cooling channels and extending into said joints between said successive courses of said profiled exterior bricks.

6. The furnace of claim 5, wherein said channels are defined by complementary recesses along adjacent upper and lower portions respectively of successive courses of said profiled exterior bricks.

7. The furnace of claim 6, wherein said profiled exterior bricks have tapered external edges so as to define gaseous media cooling channels having a generally triangular cross section.

8. The furnace of claim 1, wherein said cooling plates are made of copper or a copper alloy, brass, bronze, cast iron, aluminum alloys, silver, high temperature steels, refractory metals and their alloys, graphite, silicon carbide, or aluminum nitride.

9. The furnace of claim 5, wherein said refractory lining further comprises internal bricks remote from said support structure, and wherein said profiled channel bricks are shorter than said internal bricks to accommodate said cooling plates in contiguous courses of said internal bricks and said profiled channel bricks.

10. The furnace of claim 1, further comprising inlets in said support structure to allow gaseous cooling media to enter said channels, and outlets to allow gaseous media to be exhausted from said channels.

11. The furnace of claim 10, wherein the inlets and outlets are concentric.

12. The furnace of claim 10, further comprising a blower for forcing gaseous media into said inlets and through said channels.

13. The furnace of claim 1, wherein the gaseous media is air.

14. The furnace of claim 1, further comprising a metallic conduit within said channels, said conduit containing said gaseous media, and said conduit thermally contacting said cooling plates.

15. The furnace of claim 14, wherein said conduit is joined to said support structure.

16. The furnace of claim 14, wherein said cooling plates are made of copper or a copper alloy, brass, bronze, aluminum or an aluminum alloy, refractory metal, graphite, silicon carbide, or aluminum nitride.

17. The furnace of claim 14, wherein said cooling plates are attached to said conduit by bolts, screws, dovetails, adhesive, or welding.

18. The furnace of claim 17, wherein said cooling plates extend within said conduit so as to be thermally contacting said gaseous cooling medium.

19. The furnace of claim 16, wherein said conduit applies a spring force to said cooling plates.

20. The furnace of claim 1, wherein said cooling plates have a protective coating resistant to corrosion, oxidation and/or liquid metal/matte or slag attack.

21. The furnace of claim 20, wherein said coating is made of nickel or a nickel alloy, chrome or chrome alloy, aluminum or aluminum alloy, silicon, silicon carbide, or any combination thereof.

22. The furnace of claim 1, wherein said refractory lining has thermocouples drilled in at various depths to monitor the thickness of said refractory lining and detect ware.

23. The furnace of claim 1, wherein the gaseous media channels are located on or in a wall of said crucible.

24. The furnace of claim 1, wherein the gaseous media channels are located on or in the hearth of said crucible.

25. The furnace of claim 1, wherein said crucible further defines a roof and the gaseous media channels are located on or in the roof of said crucible.

26. The furnace of claim 1, wherein the furnace is a metallurgical furnace.

27. The furnace of claim 1, wherein said support structure includes shell plate.

* * * * *